United States Patent [19]

Hemme

[11] Patent Number: 4,673,082

[45] Date of Patent: Jun. 16, 1987

[54] GOLD BAG WITH ROTARY CLUB CARRIER

[76] Inventor: Richard O. Hemme, 3609 Stoughton Rd., Erie, Pa. 16506

[21] Appl. No.: 870,869

[22] Filed: Jun. 5, 1986

[51] Int. Cl.[4] ..... A63B 55/00

[52] U.S. Cl. ..... 206/315.6; 206/315.3; 211/70.2; 280/DIG. 6

[58] Field of Search ..... 206/315.2–315.8, 206/315.11; 273/32 E; 248/96; 211/70.2; 280/DIG. 6

[56] References Cited

U.S. PATENT DOCUMENTS

| | | | |
|---|---|---|---|
| 1,761,088 | 6/1930 | Pryde | 273/32 E |
| 2,576,360 | 11/1951 | Ramsey | 206/315.11 |
| 2,890,061 | 6/1959 | Watson | 280/DIG. 6 X |
| 3,315,815 | 4/1967 | Wittek | 211/70.2 |
| 3,425,708 | 2/1969 | Sato | 280/DIG. 6 X |
| 3,966,051 | 6/1976 | Hollister et al. | 211/70.2 X |
| 4,111,248 | 9/1978 | Leichhardt | 206/315.6 |
| 4,148,496 | 4/1979 | Zimmer | 280/DIG. 6 X |
| 4,181,167 | 1/1980 | Ret | 206/315.6 |
| 4,200,131 | 4/1980 | Chitwood et al. | 206/315.6 |
| 4,245,684 | 1/1981 | Street et al. | 206/315.4 |

*Primary Examiner*—William Price
*Assistant Examiner*—Sue A. Weaver
*Attorney, Agent, or Firm*—Charles L. Lovercheck; Wayne L. Lovercheck; Dale R. Lovercheck

[57] ABSTRACT

A golf bag and carrier is disclosed. The bag may be square or round and has an axially extending slot in one side. The bag has a circular open top, a bottom and a side slotted from top to bottom. The carrier has a circumferentially notched top. Circumferentially spaced cups are supported on the carrier bottom and half cylinder channel shaped guides connect the cups with the notches to guide golf club shafts into the cups. The carrier can be rotated to bring the desired club into alignment with the slot so that the club can be removed from the carrier and bag without lifting the club above shoulder height.

7 Claims, 7 Drawing Figures

GOLD BAG WITH ROTARY CLUB CARRIER

STATEMENT OF THE INVENTION

This invention relates to golf bags and more particularly to an improved golf bag.

The invention herein is made up of a combinatin golf bag and golf club carrier which has a rotatable top and bottom connected together and supported in an outside container that fits into a golf bag. The golf bag has an axially extending slot open at the top. The carrier has spaced notches, one for each of the golf clubs it is to contain. The golf clubs are placed into cups on the lower closure of the carrier. The upper end of the club is supported in an outwardly facing notch in the outer periphery of the top of the carrier. Thus the golfer can select the club he wishes to use, rotate the carrier to bring the slot in the carrier into alignment with the slot in the bag, grasp the head of the club and pull the club out through the slot without elevating his arm. This protects the clubs, is easier for the golfer to pull clubs out of the bag and protects the clubs from damaging each other by bumping together.

BACKGROUND OF THE INVENTION

Golf bags generally contain a set of clubs which may be 13 clubs or less or whatever number of clubs the golfer may desire. A set of clubs usually includes a putter, a pitching wedge, clubs numbered 3 through 9, a number 1 driver, a number 2 driver and a spoon.

These clubs are generally placed together in a bag where they may rub together and damage each other and cause some inconvenience in removing them. A typical golf bag is shown in U.S. Pat. No. 3,315,815 and U.S. Pat. No. 3,966,051 as well as U.S. Pat. No. 4,181,167.

OBJECTS OF THE INVENTION

It is an object of the invention to provide an improved golf bag.

Another object of the invention is to provide a golf bag with a slotted side to remove clubs.

Another object of the invention is to provide a golf bag that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE INVENTION

Figure 1:
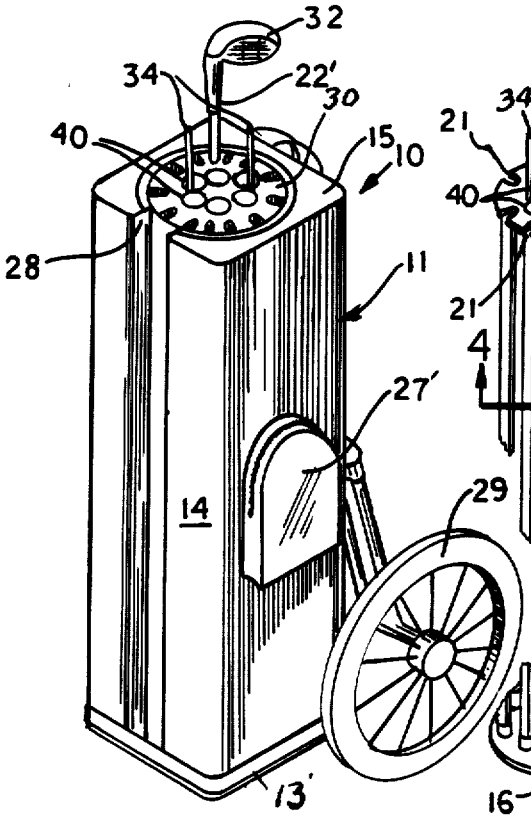
FIG. 1 is a isometric view of the square golf bag and club carrier, shown on a golf cart, according to the invention.
Figure 6:
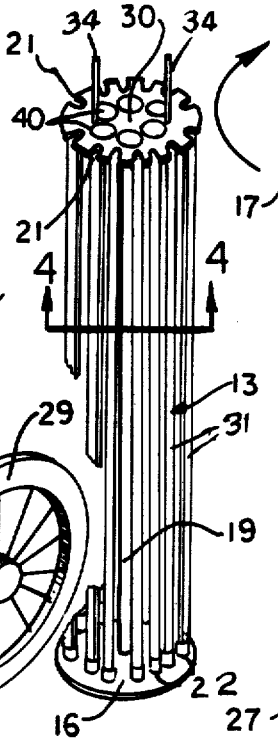
FIG. 6 is an isometric view of the club carrier.

Now with more particular reference to the drawings, I show a combination 10 of a golf bag 11 and and a club carrier 13. The bag 11 has a bottom 13' and a side wall 14, an opening in its top 15 that receives the top 30 of club carrier 13 shown supported on a golf cart 29'. The golf club bag has pocket 27' to contain golf balls, ball washers, tees and the like. The bag 11 can have a conventional carrying strap. The bag 11 has a slot 28 in the side wall 14 that communicates with the opening in the top 15. The slot 28 extends from the top 15 to the bottom 13' and allows the club 32' that is aligned with the slot 28 in the club carrier 13, at a particular time, to be removed.

Figure 2:
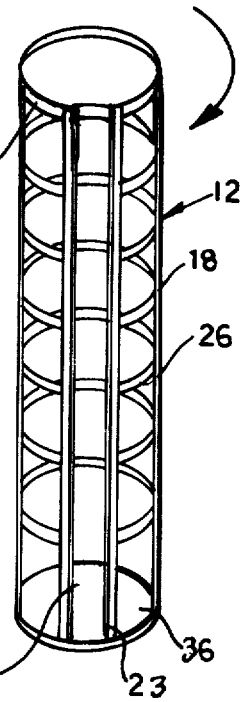
FIG. 2 is an isometric view of a framework for a round golf bag.
Figure 3:
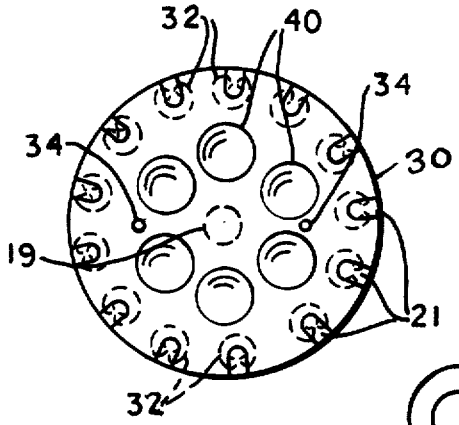
FIG. 3 is a top view of the carrier shown in FIG. 6.
Figure 7:
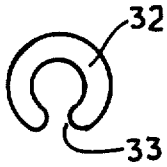
FIG. 7 is an enlarged view of one of the resilient club holding clips.
Figure 4:
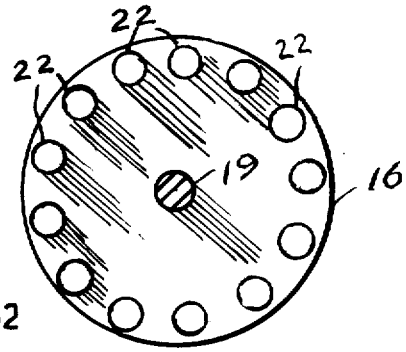
FIG. 4 is a cross-sectional view of the club carrier taken on line 4—4 of FIG. 6.

FIG. 2 shows a frame 12 which can be covered with suitable sheet material to form a cylindrical golf bag. Frame 12 has bottom 36 and circumferentially spaced vertically extending ribs 18 and ribs 23 that define slot 27. Vertically spaced hoops 26 form the case and will act to hold the vertical ribs 18 and 23 in place and support the bag cover. The frame can be made entirely of a one piece molded plastic of integral construction with a totally enclosed container with the ribs and hoops formed as ribs on the inside of the container.

The club carrier 13 has a bottom end 16 and a circular top 30. The top 30 is held in spaced relation to bottom 16 by column 19. The top 15 of the bag 11 has a circular opening that loosely receives the top 30 of the carrier 13. The bottom 16 of carrier 13 rests at the lower end of the column 19 on an anti-friction bearing supported on the bottom 13' of the bag 11 in a manner familiar to those skilled in the art, for example like the anti-friction bearing shown in U.S Pat. No. 4,111,248, FIG. 12 . The round top 30 of the club carrier 13 is rotatably received in the circular opening of the top 15 or rotatably received in round top 17 of the round bag having frame 12.

The top 30 of the club carrier 13 has circumferentially spaced outwardly directed notches 21 open to the outside. The bottom 16 of the club carrier 13 has circumferentially spaced upwardly facing cups 22 on it adjacent the outer periphery. The notches 21 are aligned with the axially spaced cups 22 on the lower end 16 of the club carrier 13. Channel shaped guides 31 which are half cylindrical in shape have their upper ends attached to the top 30 of the carrier 13 and their bottoms attached to cups 22 to guide the golf clubs 32' into cups 22. The top 30 of the club carrier 13 has spaced ball receiving recesses 40 located where they are readily available for the golfer to use.

Figure 5:
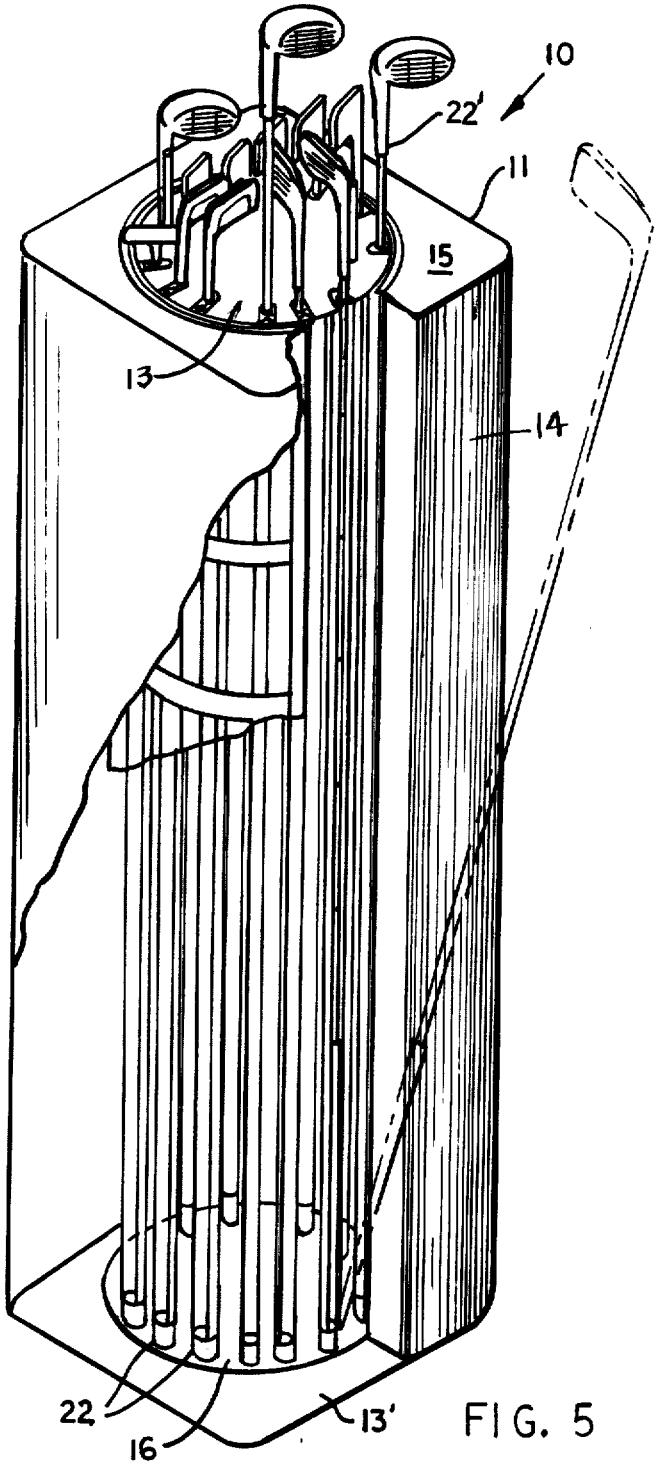
FIG. 5 is an isometric view, with some parts broken away, of the square golf bag and carrier in plane.

The carrier 13 may be received in either square bag 11 of FIGS. 1 and 5 or the round bag of FIG. 2 having frame 12. Carrier 13 can then be rotated to bring the desired club into line with slot 27 in the round bag or slot 28 in the square bag. When the particular club is aligned with the slot in a bag, the golfer can then remove the desired club through slot 27 or 28.

A plurality of resilient clips 32 are provided connected to the underside of top 30 of the carrier 13 to hold the club shafts 22' in position. The resilient clips 32 could be metallic springs or rubber toroidal shapes open at one side 33 to receive a shaft 22' of a club 32'.

Stops 34 are fixed to the top 30 of the carrier 13 to prevent the heads of the golf clubs from hitting one another.

The round top 30 of the club carrier 13 is freely rotatable in the circular opening in the top 15 of the golf bag shown in FIG. 1 or the top 17 of frame 12 shown in FIG. 2. The top 30 is freely visible in the open top of the golf bag 11 or frame 12, and any club can be selected and removed without the golfer lifting his hand above waist level.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a golf bag and a golf club carrier comprising, said bag having a bottom, side wall and a top, said bag top having a circular opening, said carrier having a circular bottom end, a circular top and means attaching said carrier top to said bottom end holding said carrier top and said carrier bottom end in spaced relation to each other, said club carrier being disposed in said bag with said carrier top rotatably received in said circular opening in said bag top, said carrier bottom end resting on said bag bottom, said carrier bottom end having a plurality of circumferentially spaced upwardly facing cups having side walls defining a hollow enclosure attached thereto, said carrier top having a plurality of circumferentially spaced outwardly opening notches therein, said notches being axially aligned with said cups on said carrier bottom end, said bag having an axially extending slot therein, said slot extending from said bag bottom to said bag top and communicating with said circular opening in said bag top, golf clubs having a first end of their shafts received in said cups and an intermediate part of said shaft being received in said notches, said clubs having a second end extending above said bag top whereby said clubs can be removed from said bag through said slot, means for rotating said carrier in said bag to selectively bring each said club into alignment with said slot in said bag.

2. The combination recited in claim 1 wherein said carrier top has resilient means engaging said clubs for holding each said club in a said notch in said top of said carrier.

3. The combination recited in claim 1 including generally hollow semi-cylindrical guides supported on said cups and extending upwardly to said carrier top concentric with said notches whereby an intermediate part of a club inserted into a said notch has its lower end guided into a said cup.

4. The combination recited in claim 1 wherein an antifriction bearing is disposed between said carrier bottom end and said bag bottom.

5. The combination recited in claim 1 wherein said carrier top has means thereon to retain each said club in position in said carrier top.

6. The combination recited in claim 1 wherein said carrier top has ball receiving recesses molded therein to receive golf balls.

7. In combination a golf club carrier and golf bag, said bag having a side wall enclosure with a top, an opening in said top and a closed bottom, a slot in one side of said bag extending from said top to said bottom and communicating with said opening in said bag top, said club carrier having a top and bottom received in said bag with said club carrier resting on said bag bottom and rotatable therein, said club carrier top being rotatably received in said opening in said bag top, said club carrier top having circumferentially spaced outwardly directed notches, said club carrier bottom having circumferentially spaced cup means having side walls defining a hollow enclosure facing upwardly for receiving ends of golf clubs, said cup menas each being adapted to receive an end of a golf club shaft with said club shaft being received in a said notch, means for rotating said carrier to align a said club with said slot in said bag whereby said club can be removed radially from said bag through said slot.

* * * * *

Disclaimer and Dedication 4,673,082.—*Richard O. Hemme*, Erie, Pa. GOLD BAG WITH ROTARY CLUB CARRIER. Patent dated June 16, 1987. Disclaimer and Dedication filed Oct. 6, 1988, by the inventor.

Hereby disclaims and dedicates to the Public claims 1, 2, 4, 5 and 7 of said patent.

[ *Official Gazette July 25, 1989* ]